US005285587A

United States Patent [19]

Krenzler

[11] Patent Number: 5,285,587

[45] Date of Patent: Feb. 15, 1994

[54] UNDERWATER MINING DREDGE

[76] Inventor: Leo M. Krenzler, 1142 Industry Dr., Seattle, Wash. 98188

[21] Appl. No.: 38,467

[22] Filed: Mar. 29, 1993

[51] Int. Cl.[5] ..... E02F 3/88

[52] U.S. Cl. ..... 37/323; 37/322; 37/344; 37/317; 37/307

[58] Field of Search ..... 37/58, 59, 62, 61, 63, 37/72, 76, 77, 78, 54, DIG. 8; 299/8, 9

[56] References Cited

U.S. PATENT DOCUMENTS

| | | | |
|---|---|---|---|
| 80,225 | 7/1868 | Robertson . | |
| 885,930 | 4/1908 | Lake . | |
| 2,125,740 | 8/1938 | Schacht . | |
| 2,605,090 | 7/1952 | Jacobsen | 37/59 X |
| 2,774,569 | 12/1956 | Jacobsen . | |
| 2,995,842 | 8/1961 | Korste . | |
| 3,893,249 | 7/1975 | Wolters . | |
| 3,949,496 | 4/1976 | de Konig et al. . | |
| 4,253,255 | 3/1981 | Durell . | |
| 4,409,746 | 10/1983 | Beck . | |
| 4,854,058 | 8/1989 | Sloan et al. | 37/58 X |
| 4,943,186 | 7/1990 | Van Weezenbeek | 37/78 X |
| 4,995,175 | 2/1991 | Winter | 37/58 X |
| 5,199,767 | 4/1993 | Jimbo | 299/8 |

*Primary Examiner*—Randolph A. Reese
*Assistant Examiner*—J. Russell McBee
*Attorney, Agent, or Firm*—Teresa J. Wiant; Joan H. Pauly; Glenn D. Bellamy

[57] ABSTRACT

Dredging apparatus (10) is provided with a flow conduit (18), a first pump (28), a second pump (30), and two valves (34, 44). The flow conduit (18) comprises a first leg (20) extending downwardly to a lower portion (22) and a second leg (24) extending upwardly from the lower portion (22). A fluidizing nozzle (32) is carried by the first leg (20). An intake aperture (26) is provided on the lower portion (22) and is directed downwardly. The dredging apparatus (10) may be used to dredge up material when the material is in a water suspension (48), and to probe through material by scattering material. The valves (34, 44) are operated to switch the apparatus between various modes of operation and to increase the effectiveness of the apparatus.

37 Claims, 5 Drawing Sheets

Fig.5
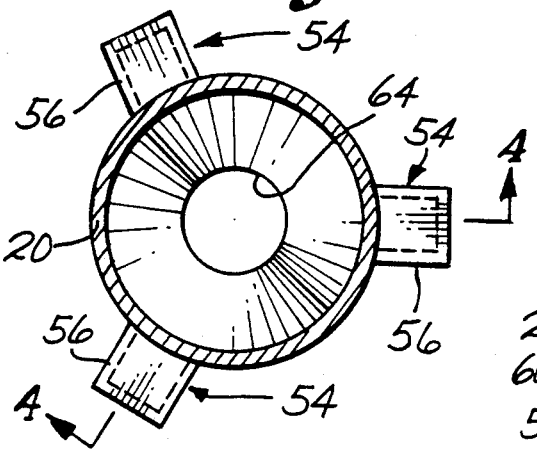
Fig.6
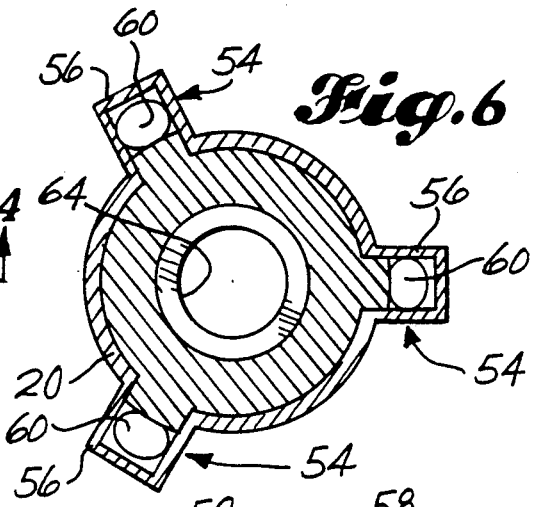
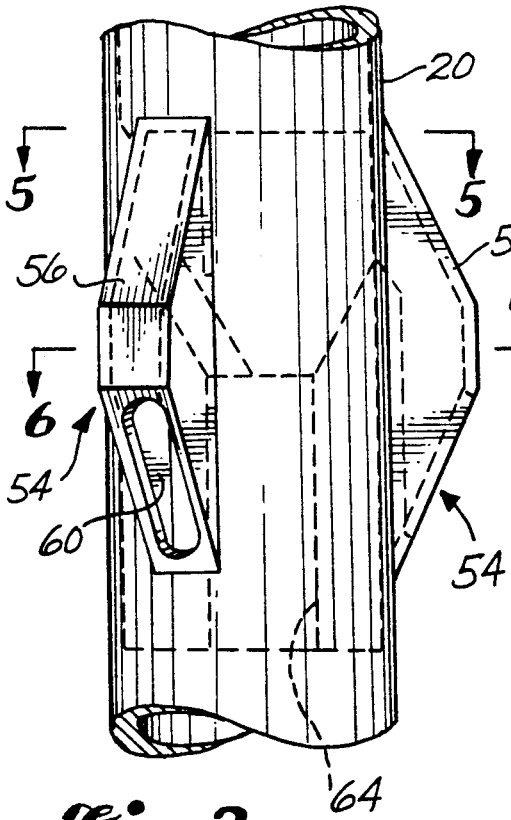
Fig.3
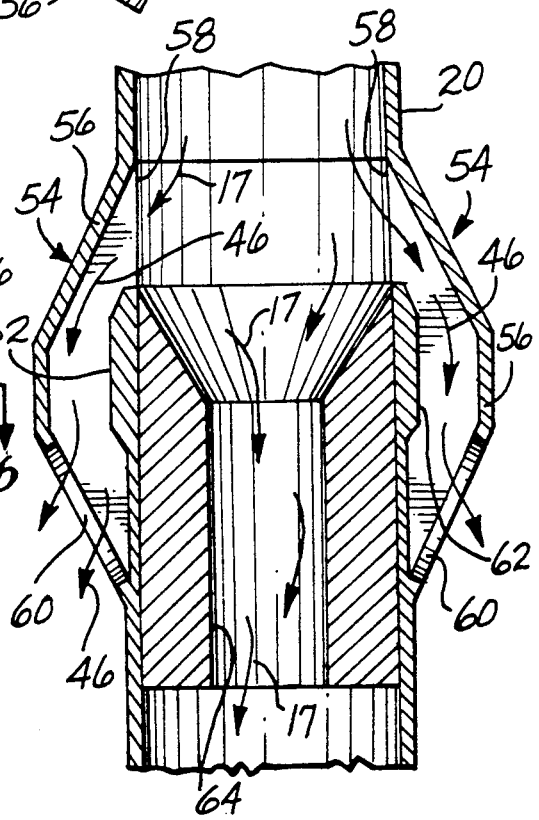
Fig.4

UNDERWATER MINING DREDGE

DESCRIPTION

1. Technical Field

The present invention generally relates to dredging apparatus and a method for dredging, and more particularly, to dredging apparatus which, when in use, has a first leg that extends downwardly into a body of water to a U-shaped lower portion that has a substantially constant cross section, a downwardly directed intake aperture in the lower portion, and a second leg extending upwardly from the lower portion, and to a method for dredging material from a bottom area of a body of water where the material is covered by overburden. The apparatus has one or more valves to permit a plurality of modes of operation, including scattering overburden, recovering desired material, and clearing the aperture.

2. Background of the Invention

Precious material, such as gold, is found in deposits with other material on bottom areas of bodies of water. Often, the precious material is deposited on bedrock. Dredging allows removal of materials from such underwater bottom areas. After the materials have been dredged up, the precious material is recovered from the dredged material. In some underwater locations, deposits of precious material are covered by a layer of silt or overburden. In order to recover the precious material, the silt and the precious material are dredged from the bottom. Since the dredged silt is of little, if any, value its presence in the dredged materials is a nuisance that increases the cost and difficulty of the dredging operation.

Dredging apparatus is disclosed in U.S. Pat. No. 2,125,740, issued to Schacht. The apparatus has a plurality of primary water supply pipes for delivering a primary stream of water. In use, part of the primary stream passes through a jet nozzle which cuts into a bed of material and forms a conical depression down the slope of which may slide the material being excavated. Any solids that reach the bottom of the depression are placed in suspension by the jets. A secondary stream entrains and engulfs the solids and carries them up an intake. The portion of the primary stream that does not pass through the nozzle passes through a progressively decreasing passageway. The pressure head of the primary stream is converted into a velocity head as it approaches an orifice into another passage. After passing through the orifice, the primary stream is under little, if any, pressure head. The secondary stream, with its solids, is drawn through a conical stream in the passage where it encounters the primary stream and is completely surrounded by the high velocity annular converging primary stream which entrains and engulfs the secondary stream and carries it upwardly to the surface of the water through the passage.

U.S. Pat. No. 80,225, issued to Robertson, illustrates a number of embodiments of excavating machines. In the operation of each embodiment, the excavating machine is moved forward to force a mouthpiece carried by a conduit into a bed of material to loosen the material and cause the material to enter the conduit.

DISCLOSURE OF THE INVENTION

The present invention provides dredging apparatus for removing material from a bottom area of a body of water. A flow conduit is provided which has a lower portion, a first leg, and a second leg. Each leg extends upwardly from the lower portion. The conduit is operable to communicate flow between the legs. The lower portion has at least one intake aperture directed generally downwardly for receiving a water suspension of the material from the bottom area. A first pump is operably connected to the first leg. A second pump is operably connected to the second leg. The first pump and the second pump are each operable to provide flow through the conduit. A fluidizing nozzle is carried by the first leg. The nozzle is positioned to divert out of the conduit a portion of fluid flowing through the first leg toward the lower portion. The diverted fluid is directed against the bottom area for agitating and thereby generating the water suspension.

According to an aspect of the invention, the apparatus also includes a flow valve operably connected to the second leg. The flow valve has an open position and a closed position. The open position permits flow from the first leg through the second leg. The closed position prevents flow from the first leg through the second leg such that the flow from the first leg exits the conduit through the nozzle and the aperture. Preferably, when the flow valve is in its open position, it permits flow through the second leg toward the lower portion, so as to permit flow from both legs to the lower portion and out through the aperture.

A preferred feature of the invention is a control valve operably connected to the first leg. The control valve has a fully open position to permit unrestricted flow from the first leg to the lower portion. The control valve also has an intermediate position to provide restricted flow from the first leg to the lower portion to create suction downstream of the control valve. The control valve may have a closed position. Flow is prevented from the first leg to the lower portion to create suction in the lower portion when the control valve is in its closed position and the flow valve is in its open position.

The configuration of the lower portion may be varied and may include a single aperture or a plurality of apertures. The nozzle may also take various forms. Preferably, it extends from the first leg adjacent the lower portion and comprises three jets spaced 120 degrees around the circumference of the first leg.

According to another aspect of the invention, the conduit has a substantially constant cross-sectional diameter substantially from the nozzle to the lower portion and past the intake aperture. This conduit configuration has a number of advantages. A major advantage is that it permits the structure of the conduit to have maximized simplicity, which in turn helps minimize the cost of the apparatus. Embodiments of the apparatus of the invention that include one or more of the valves described above in combination with the constant cross section provide both low cost and a range of functional capabilities.

According to still another aspect of the invention, the flow conduit includes a substantially U-shaped lower portion, a first leg, and a second leg. Each leg extends substantially vertically from the lower portion. The lower portion has a substantially horizontal bight section that includes the intake aperture. The lower portion preferably has a substantially constant cross section.

The invention also provides a method for removing material that is covered with overburden from a bottom area of a body of water. The method employs a dredge that includes a flow conduit having a lower portion and first and second upwardly extending legs that communicate with each other through the lower portion, a fluidizing nozzle carried by the first leg, and a downwardly directed intake aperture in the lower portion. The conduit is positioned in the water such that the intake aperture is directed towards the bottom area above the overburden. Fluid is pumped through the first leg to the lower portion and out through the aperture, and the conduit is moved downwardly, to clear the overburden away from the material. Then, fluid is pumped through the conduit down the first leg, through the lower portion, and up the second leg. Simultaneously, a portion of the fluid is directed to exit the conduit through the nozzle, to stir up the material and thereby generate a water suspension of the material. The water suspension is allowed to enter the conduit through the aperture and to mix with the fluid, and pumping of the fluid is continued to move the fluid and the water suspension up the second leg.

If the aperture becomes clogged, the step of pumping the fluid through the conduit may be interrupted. Then, fluid is pumped down the first leg to the lower portion and out through the aperture to clear the aperture. Flow is prevented from the lower portion through the second leg. When the aperture has been cleared, the fluid pumping is resumed. During the clearing step, fluid may also be pumped through the second leg to the lower portion to help clear the aperture.

The clearing of the overburden preferably includes directing a portion of the fluid to exit the conduit through the nozzle. For some types of overburden, especially those that are more dense or compacted, it is also preferable to pump fluid down both legs of the conduit.

The step of allowing the water suspension to enter the conduit may be carried out in various ways. For example, it may comprise restricting flow through the first leg to the lower portion to create suction at the aperture. Preferably, there is initial unrestricted flow through the first leg to the lower portion. Then, flow is restricted through the first leg to the lower portion to create suction at the aperture. In addition, after the unrestricted flow and before the restricted flow, flow may be prevented through the first leg to the lower portion to increase suction at the aperture.

The method of the invention is highly efficient and may be readily adapted to various types of conditions. The probing through overburden above the desired material avoids the nuisance of having undesired overburden material mixed with the dredged target material. The preferred aspects of the method in which the clearing of the aperture and/or the clearing of overburden can be accomplished by pumping fluid down one or both legs makes it possible to easily adapt the method to different types of overburden and target material. For example, pumping fluid down one leg of the conduit to clear loose overburden, such as silt, is generally all that is required. In situations in which the overburden is difficult to clear because it is compacted or for some other reason, pumping fluid down both legs of the conduit increases the clearing force to allow the conduit to move downwardly and expose the underlying material. The procedure for clearing the conduit aperture can similarly be varied to adapt to the degree of clogging of the aperture. The manner in which the step of bringing up the water suspension through the conduit may be varied allows the recovery procedure to be accomplished with maximum efficiency and virtually without interruption. The apparatus aspects of the invention make it possible to carry out the method in all its variations with apparatus having relatively simple structure so that the overall operation has maximized cost effectiveness.

These and other advantages and features will become apparent from the detailed description of the best mode for carrying out the invention that follows.

BRIEF DESCRIPTION OF THE DRAWINGS

In the drawings, like reference numerals refer to like parts throughout the various views, unless specifically indicated otherwise, and:

FIG. 3 is an enlarged elevational view of the portion of the conduit shown in FIGS. 1 and 2 that includes the nozzle;

FIG. 4 is a sectional view of the nozzle shown in FIG. 3 illustrating the flow pattern of fluid through the nozzle;

FIG. 5 is a cross-sectional view taken across line 5—5 in FIG. 3;

FIG. 6 is a cross-sectional view taken across line 6—6 in FIG. 3;

BEST MODE FOR CARRYING OUT THE INVENTION

Figure 1:
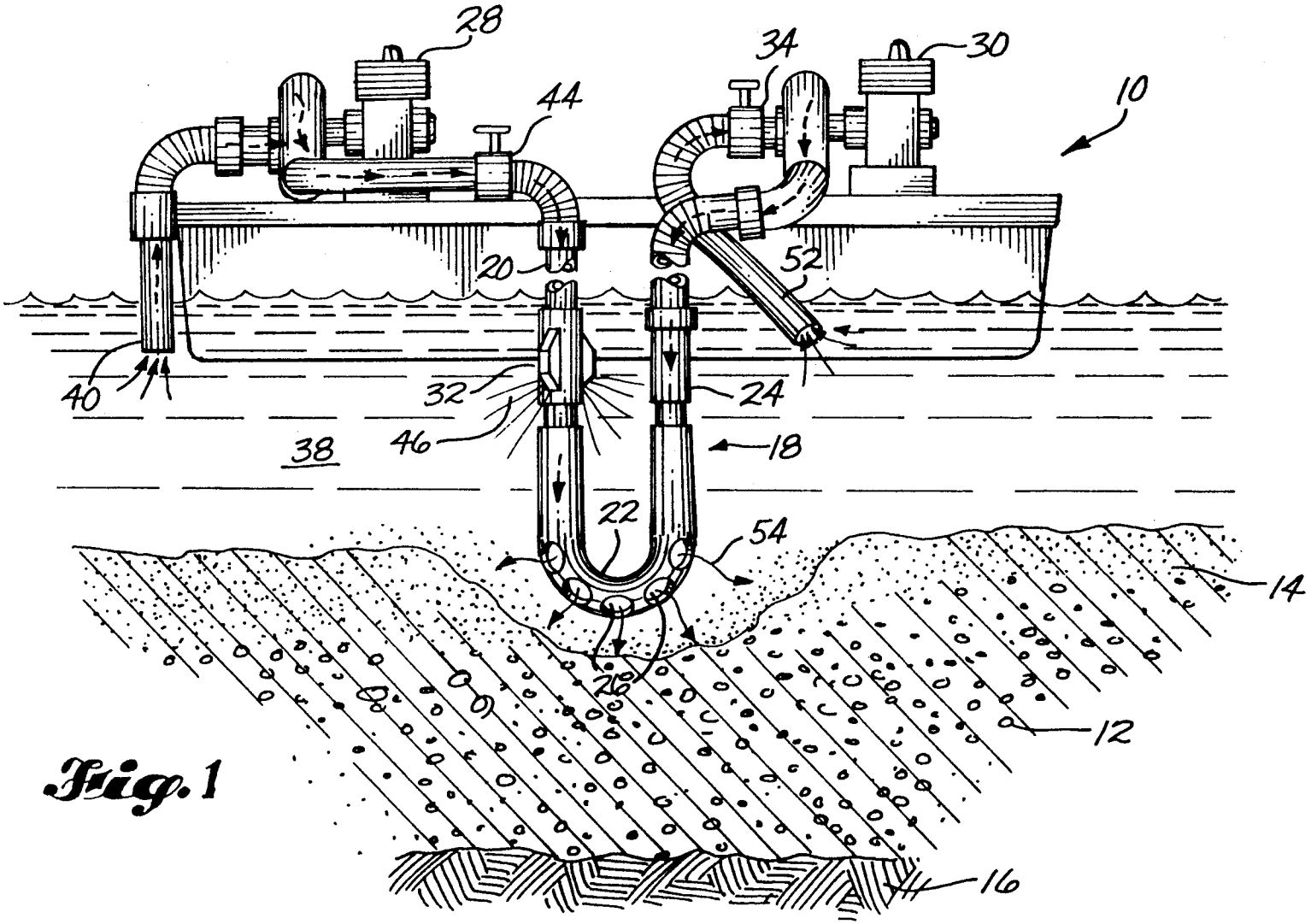
FIG. 1 is an elevational view of the dredge apparatus of the present invention clearing overburden from material on a bottom area of a body of water.
Figure 2:
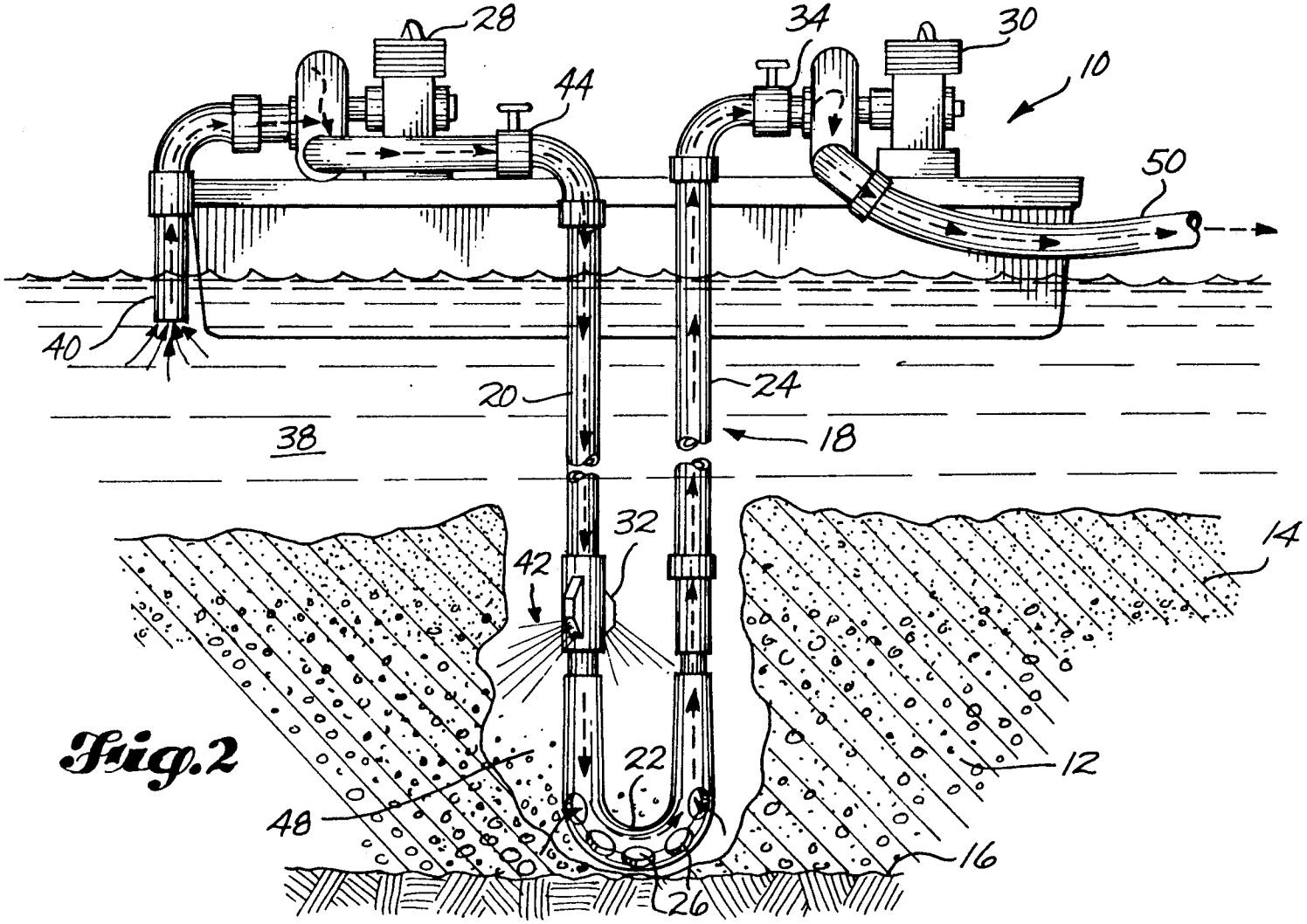
FIG. 2 is an elevational view of the dredge apparatus of the present invention dredging up material from a bottom area of a body of water.

The present invention provides dredging apparatus for dredging up material from a bottom area of a body of water. The invention also provides a method for dredging such material when it is covered by a layer of overburden. FIGS. 1 and 2 illustrate the best mode of the dredging apparatus 10 of the invention. The dredging apparatus and the method of dredging of the invention are particularly useful for removing precious material from underwater areas. Often, the precious material 12 is deposited on bedrock 16 and is covered by a layer of overburden 14.

The dredging apparatus 10 comprises a flow conduit 18 which includes a first leg 20, a lower portion 22, and a second leg 24. The legs 20, 24 extend substantially vertically from the lower portion 22. The lower portion 22 includes at least one intake aperture 26 directed generally downwardly. A first pump 28 is operably connected to the first leg 20. A second pump 30 is operably connected to the second leg 24. Each of the pumps 28, 30 is operable to provide a flow 17 (FIG. 4) through the conduit 18. The illustrated pumps 28, 30 are of the same size and type, but different sizes and/or types could also be provided. In their preferred construction, the conduit legs 20, 24 are formed from pipe sections four to five feet in length. The sections are joined by standard connectors and, where appropriate, flex hose.

A fluidizing nozzle 32 is carried by the first leg 20. The fluidizing nozzle 32 is positioned to divert out of the conduit 18 a portion of fluid flowing through the first leg 20 towards the lower portion 22. The diverted flow 46 flows out from the nozzle 32 and agitates and generates a water suspension 48 of the material 12 in the bottom area, as shown in FIG. 2.

According to the present invention, various modes of operation of the dredging apparatus 10 are carried out by controlling flow of fluid in the conduit. The dredging apparatus can be operated to influence a flow of fluid into the conduit 18 through the aperture 26 or out of the conduit 18 through the aperture 26. In addition, the dredging apparatus is preferably configured such that the amount of material entering the conduit through the aperture 26 may be increased by manipulating the apparatus to increase suction at the aperture 26.

The intake aperture 26 is a hole in the conduit sidewall which allows fluid or material to be communicated from outside the conduit 18 to inside the conduit 18, or from inside the conduit 18 to outside the conduit 18. The lower portion 22 includes at least one intake aperture 26, although, in preferred form, a plurality of intake apertures 26 are provided.

The flow into and out of the intake aperture 26 may be controlled by a flow valve 34 operably connected to the second leg 24. The flow valve 34 has an open position that permits flow from the first leg 20 through the second leg 24, and a closed position that prevents flow from the first leg 20 through the second leg 24. When the flow valve 34 is in its closed position, flow from the first leg 20 exits the conduit 18 through the nozzle 32 and the intake aperture 26.

The apparatus is preferably also provided with a second valve, herein denominated a "control valve" to facilitate description of the apparatus. Referring to FIGS. 1, 2, and 7–11, the control valve 44 is operably connected to the first leg 20 of the conduit 18. The control valve 44 has a closed position which prevents flow from the first leg 20 to the lower portion 22, and at least one open position that permits flow from the first leg 20 to the lower portion 22. The closed position creates suction in the lower portion 22 when the flow valve 34 on the second leg 24 is in its open position. The control valve 44 preferably has a fully open position and an intermediate position. The fully open position permits unrestricted flow from the first leg 20 to the lower portion 22, and the intermediate position provides restricted flow from the first leg 20 to the lower portion 22 to create suction downstream of the control valve 44. The manner in which the control valve 44 is operated, in cooperation with the flow valve 34 and other portions of the apparatus, to achieve various modes of operation of the apparatus is described further below.

Figure 12:
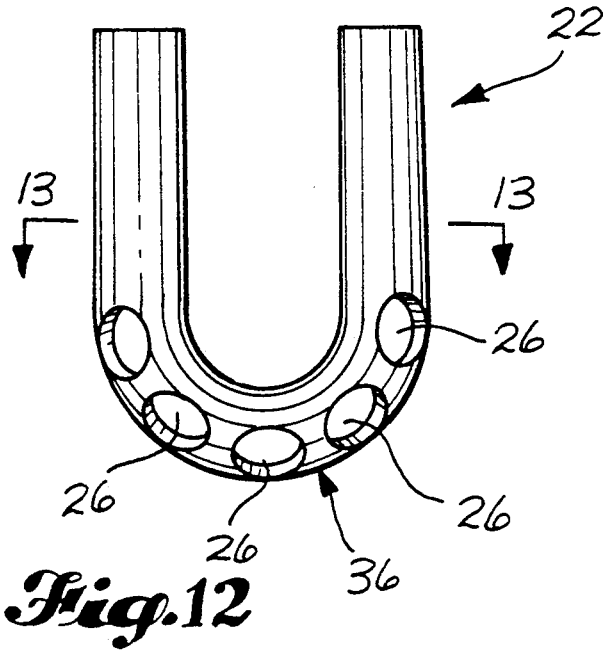
FIG. 12 is an enlarged elevational view of the lower portion of the conduit shown in FIGS. 1 and 2.

Operation of the pumps 28, 30 assists the valves 34, 44 in controlling flow into and out of the intake aperture 26. In order to maintain efficient control of the flow, the conduit 18 must be constructed such that it is not easily clogged by materials entering the conduit 18 through the aperture 26. In its preferred configuration, the conduit 18 has a substantially U-shaped lower portion 22, as illustrated in FIGS. 1, 2, and 12. The U-shaped lower portion 22 has a substantially horizontal bight section 36 having a plurality of intake apertures 26. The U-shape of the lower portion 22 prevents materials from being clogged within the conduit 18. The pumps 28, 30 may be operated to regulate the flow of fluid, including forcing flow through the apertures 26 to clear material caught in the apertures 26, and increasing suction at the apertures 26.

Figure 13:
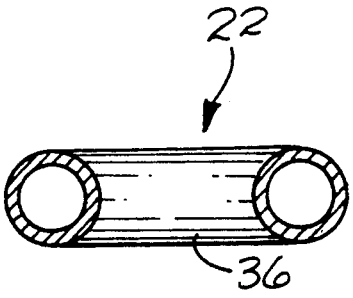
FIG. 13 is a cross-sectional view taken along the line 13—13 in FIG. 12.

The portion of the conduit 18 from the nozzle 32 to the lower portion 22 and past the intake apertures 26 preferably has a substantially constant cross section. See FIG. 13. The substantially constant cross section makes the manufacture and maintenance of this portion of the apparatus relatively simple and inexpensive. However, versatility of operation is not sacrificed. By adjusting the valves 34, 44 and the pumps 28, 30, suction may be increased or decreased at the apertures 26, and the direction and volume of flow may be changed, to maximize production of dredged material.

The best mode of the method of the invention is carried out using the apparatus 10 described above. FIGS. 1, 2, and 7–11 illustrate the various modes of operation using the apparatus 10. However, it should be understood that the method may also be carried out using apparatus other than the illustrated apparatus 10 without departing from the spirit and scope of the invention.

Precious material at the bottom of a body of water is often deposited under a layer of overburden, such as silt. In conventional dredging procedures, the overburden is dredged prior to dredging the precious material. Since the overburden is usually of little value, it is often dumped back into the water after it has been brought to the surface. Dredging and separating the overburden adds to the cost of recovering the precious material. The present invention provides a way of probing through the overburden to avoid the dredging and separating thereof and, thereby, avoid the additional cost.

The initial probing operation is illustrated in FIG. 1. The precious material 12 is deposited underneath a layer of overburden 14, which must be cleared before the dredging of the material 12 can be accomplished. The dredging apparatus 10 has intake pipes 40, 52 communicating with the first and second conduit legs 20, 24, respectively. Each pipe 40, 52 terminates in the body of water 38 relatively near the surface. The pumps 28, 30 are operated to draw water into the conduit legs 20, 24 through the intake pipes 40, 52. In preferred form, this is accomplished by manually switching the pipe couplings on pump 30. Water from intake pipe 40 flows through the open control valve 44 and into the first leg 20. A portion of the flow through the first leg 20 exits the conduit 18 through the fluidizing nozzle 32. Water from intake pipe 52 flows through the open flow valve 34 and into the second leg 24. Flow from both legs 20, 24 enters the lower portion 22 and is forced out of the conduit 18 through the intake apertures 26. During the probing operation, the conduit 18 is positioned so that the apertures 26 are directed toward the bottom area above the overburden 14.

The flow out from the intake apertures 26 and the diverted flow 46 from the fluidizing nozzle 32 probe into the overburden and force the overburden 14 away from the area underneath the nozzle 32 and the apertures 26. The overburden 14 is scattered away from the material 12, but it is not dredged to the surface. The conduit 18 is lowered into the water to continue to scatter the overburden 14. When the overburden 14 is loose, e.g. silt, the scattering procedure may be carried out by pumping water through only one of the two conduit legs 20, 24, preferably the first leg 20. The dredging apparatus 10 is operated to probe through the overburden 14 until at least substantially all of the overburden 14 is moved away from the material 12. Then, the apparatus 10 is operated to dredge the material 12 from the bottom area.

FIG. 2 illustrates the dredging apparatus 10 dredging material 12 from the bottom area. In this mode of operation, the first pump 28 pumps water into the intake pipe 40, through the at least partially open control valve 44, and to the first leg 20 of the conduit 18. A portion of the flow through the first leg 20 is diverted out of the conduit 18 through the fluidizing nozzle 32. The diverted flow 46 is directed against the material 12 and agitates and generates a water suspension 48 of the material 12. The water suspension 48 enters the flow conduit 18 through intake apertures 26 in the lower portion 22 of the conduit 18 and mixes with the undiverted flow from the first leg 20. The mixture of the water suspension 48 and the undiverted flow is pumped from the lower portion 22 into and through the second leg 24. The mixture flows through the open flow valve 34 and into an output pipe 50. The output pipe 50 leads to separating apparatus, such as a sluice, for separating the precious material from the water and other materials. The conduit 18 is lowered into the water as material 12 is dredged up to maintain the lower portion 22 within a predetermined degree of proximity to the material 12. If clogging of the apertures 26 occurs during the dredging procedure, the procedure may be interrupted to clear the apertures 26, as described below and shown in FIGS. 7 and 8. Once the apertures 26 have been cleared, the dredging may be resumed.

The nozzle 32 is positioned to divert flow to generate a water suspension 48, as described above. The nozzle 32 may be carried by any portion of the conduit 18 but is preferably carried by the first leg 20 adjacent to the lower portion 22. FIGS. 3–6 illustrate the preferred configuration of the nozzle 32, which comprises three jets 54 extending from the first leg 20. The jets 54 are spaced approximately 120° from each other around the circumference of the first leg 20. As flow 17 passes through the first leg 20, a portion of the flow 17 is diverted out from the first leg 20 through the jets 54 of the nozzle 32. The non-diverted flow 17 continues through the first leg 20.

Referring to FIGS. 3–6, each jet 54 has a trapezoidal housing 56 which projects outwardly from the first leg 20 of the conduit 18. The nonparallel sides of the housing 56 taper toward each other as they project outwardly. An opening 58 in the first leg sidewall communicates with the upstream end of the housing 56. The sidewall has an increased outer diameter portion 62 adjacent to the opening 58. This portion 62 is beveled at each of its ends and extends into the interior of the housing 56. The downstream nonparallel side of the housing 56 has an opening 60 formed therethrough. Downstream of the leg opening 58, the inner surface of the conduit tapers inwardly to a reduced diameter portion 64. Flow 17 down through the leg 20 splits into two portions when it reaches the leg openings 58. The diverted portion enters the housings 56 of the jets 54 and is directed downwardly and outwardly through the jet openings 60 by the inner surfaces of the housings 56 and the enlargement 62 on the outer surface of the conduit 18. The narrowing of the conduit 18 just downstream of the openings 58 enhances the volume and force of the diverted flow 46.

FIGS. 7–11 schematically illustrate the various modes of operation of the dredging apparatus 10. The pumps 28, 30 are each illustrated by a circle with a line through the center of the circle. Arrows are used to indicate that the pump is "on" and the direction of flow. Circles without arrows indicate that the pump is "off." Vertical arrows through the center of the valves 34, 44 indicate that the valve is open and the direction of flow. A horizontal line through the center of the valve indicates that the valve is closed. A diagonal line indicates that the valve is partially open. Flow out of the fluidizing nozzle 32 is indicated at 46. Flow through the conduit 18 and the intake apertures 26 and the direction of such flow are indicated by arrows. The first pump 28 is off if the control valve 44 is closed. The second pump 30 is off if the flow valve 34 is closed.

Figure 7:
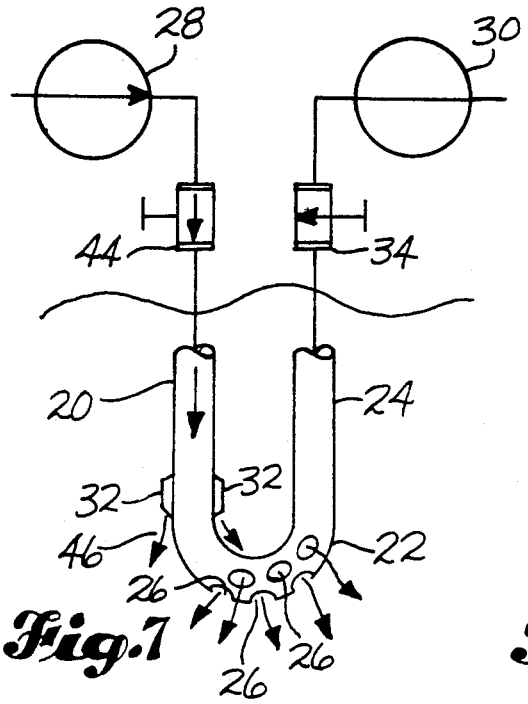
FIG. 7 is a schematic view of the dredging apparatus in a mode of operation useful for probing through overburden or unclogging the apertures.

FIG. 7 illustrates a mode of operation in which the first pump 28 is on, the control valve 44 is fully open, the second pump 30 is off, and the flow valve 34 is closed. In this mode of operation, flow through the first pump 28 passes through the control valve 44 and into the first leg 20. A portion of the flow is diverted out of the conduit 18 through the fluidizing nozzle 32. Since the flow valve 34 is closed, the non-diverted flow passes from the first leg 20 into the lower portion 22 and exits the conduit 18 through the intake apertures 26. This mode of operation may be used to probe through loose overburden, as described above. It may also be used to dislodge material caught in the intake apertures 26.

Figure 8:
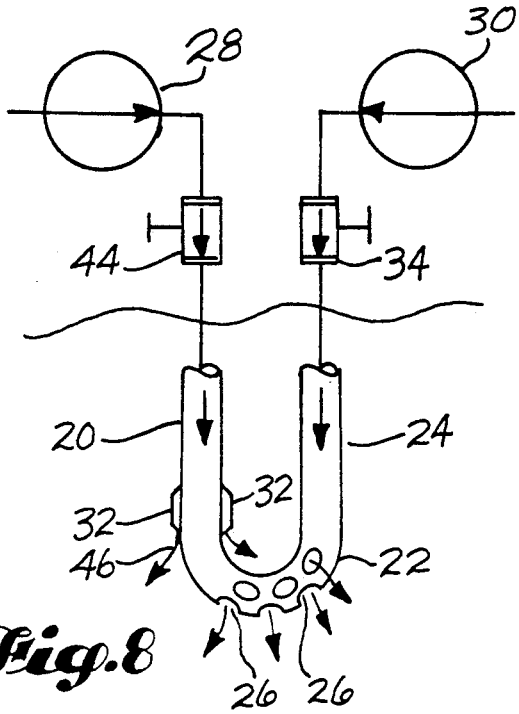
FIG. 8 is a schematic view of the dredging apparatus in a mode of operation used for probing through compacted overburden or unclogging the intake apertures.

FIG. 8 illustrates a mode of operation like the one shown in FIG. 7, except that pump 30 is on and the flow valve 34 is open. Water flows down both legs 20, 24 and out of the conduit 18 through the apertures 26. The flow out of the apertures 26 in this mode of operation is greater than that illustrated in FIG. 7. This mode of operation is useful for probing through compacted or dense overburden or for speeding up the probing procedure. In addition, this mode of operation is useful for dislodging material caught in the intake apertures 26, especially if the material was not cleared using the mode illustrated in FIG. 7.

Figure 9:
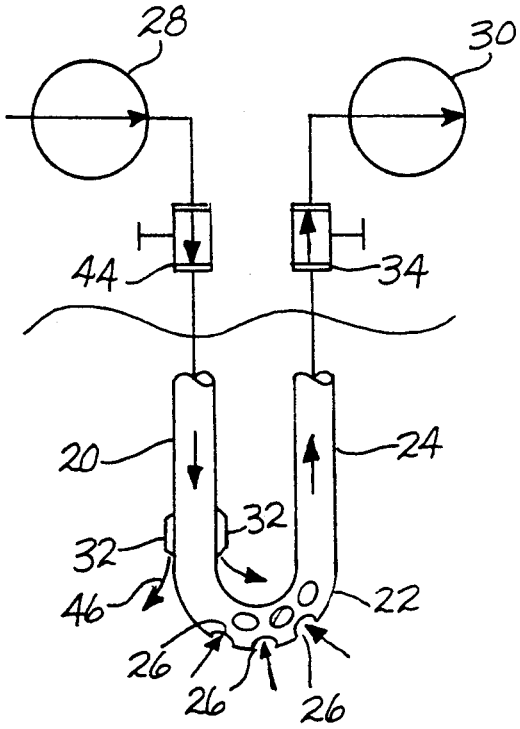
FIG. 9 is a schematic view of the dredging apparatus in a mode of operation for dredging material from the bottom area.

FIG. 9 illustrates a mode of operation in which both pumps 28, 30 are on and both valves 34, 44 are open. Flow travels into the conduit 18 through the first leg 20 and out of the conduit 18 through the second leg 24. A portion of the flow exits the first leg 20 through the fluidizing nozzle 32. The diverted flow 46 agitates and generates a water suspension of material. The water suspension enters the conduit 18 through the intake apertures 26, mixes with the flow, and is pumped from the lower portion 22 into the second leg 24 and out of the conduit 18, as described above. This mode of operation is used during an initial stage of the dredging procedure. It is best for getting the dredging started, but is not the most efficient dredging mode.

Figure 10:
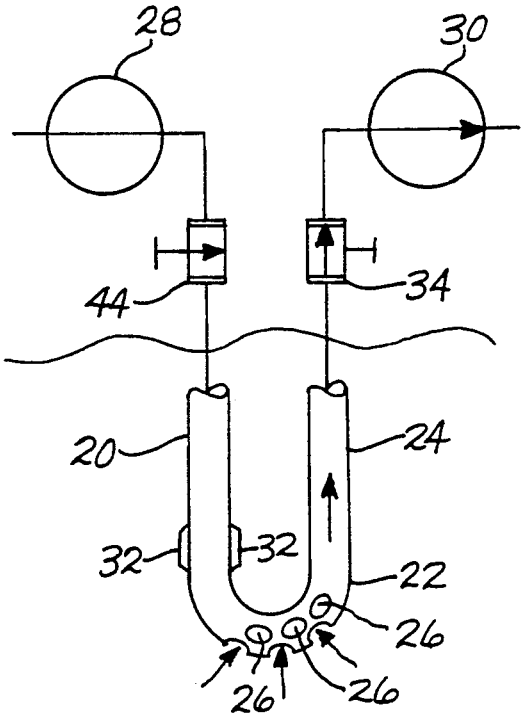
FIG. 10 is a schematic view of the dredging apparatus in a mode of operation for increasing suction in the lower portion of the conduit.

FIG. 10 illustrates a mode of operation like the one shown in FIG. 9, except that pump 28 is off and the control valve 44 is closed. The second pump 30 draws the water suspension into the conduit 18 through the intake apertures 26 and up through the second leg 24. This mode of operation increases suction at the apertures 26 and the amount of water suspension entering the conduit 18 through the apertures 26. It is used to increase production of dredged material when the flow of material diminishes.

Figure 11:
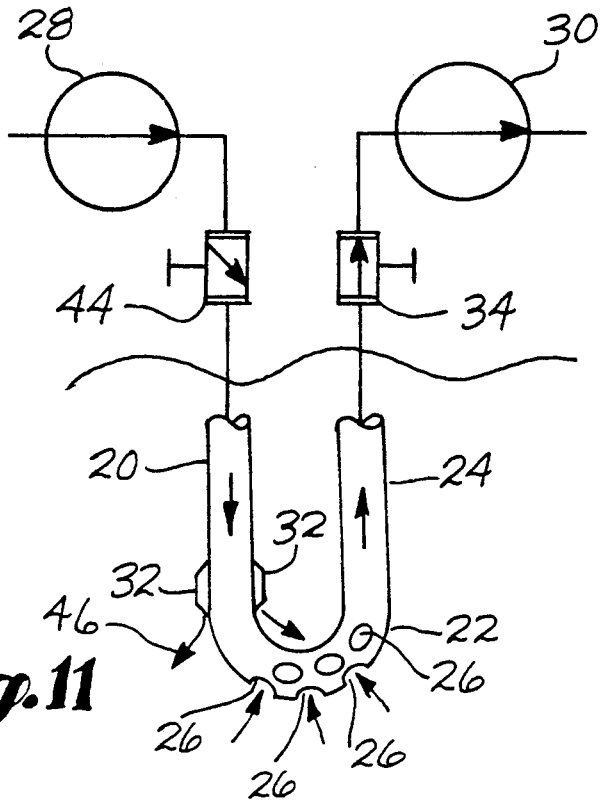
FIG. 11 is a schematic view of the dredging apparatus illustrating its ideal mode of operation for dredging material from the bottom area.

FIG. 11 illustrates a mode of operation like the one shown in FIG. 9, except that the control valve 44 is partially, rather than fully, open. The intermediate position of the valve 44 restricts flow through the first leg 20 to the lower portion 22. The restriction creates suction at the apertures 26 to increase production of dredged material. This mode of operation is the optimal production mode for dredging. It is used after the mode shown in FIG. 9 and/or the mode shown in FIG. 10 have been employed to initiate flow of dredged material.

The modes of operation illustrated in FIGS. 7–11 may be used in various sequences. If the material 12 to be dredged is deposited beneath a layer of overburden 14, the dredging apparatus is preferably first operated as illustrated in FIG. 7 and/or FIG. 8 to clear the overburden 14. Once the overburden 14 has been cleared, the apparatus is preferably operated in the mode illustrated in FIG. 9, and then in the mode illustrated in FIG. 11, to dredge the material 12. If the amount of material 12 being dredged begins to decrease, the mode illustrated in FIG. 10 is preferably used to increase suction at the apertures 26 and thereby increase the amount of material 12 being dredged up. This mode of operation may cause the intake apertures 26 to become plugged. The plugged apertures 26 are preferably cleared using the mode(s) of operation illustrated in FIGS. 7 and 8. After a short time (e.g. a few seconds) of operating according to the mode shown in FIG. 7 or 8, the apparatus may be returned to the ideal production mode illustrated in FIG. 11. Any other clogging of the apertures 26 is preferably also cleared as illustrated in FIG. 7 and/or FIG. 8.

The flow through the conduit 18 may be any liquid or gas. In preferred form, the fluid is water taken from an upper area of the body of water 38 where the dredging is being performed, as illustrated in FIGS. 1 and 2.

The conduit 18 may be constructed of any suitable material. PVC pipe has been found to be especially useful for constructing the conduit 18 at relatively low cost.

Although the preferred embodiments of the invention have been illustrated and described herein, it is intended to be understood by those skilled in the art that various modifications and omissions in form and detail may be made without departing from the spirit and scope of the invention as defined by the following claims.

What is claimed is:

1. Dredging apparatus for removing material from a bottom area of a body of water, comprising:

a flow conduit having a lower portion, a first leg, and a second leg; each said leg extending upwardly from the lower portion, said conduit being operable to communicate flow between the legs, and said lower portion having at least one intake aperture directed generally downwardly for receiving a water suspension of said material from said bottom area;

a first pump operably connected to the first leg, said first pump being operable to provide flow through said conduit;

a second pump operably connected to the second leg, said second pump being operable to provide flow through said conduit;

a fluidizing nozzle carried by said first leg and positioned to divert out of said conduit a portion of fluid flowing through said first leg toward said lower portion, said diverted fluid being directed against said bottom area for agitating and thereby generating said water suspension; and a flow valve operably connected to said second leg, said valve having an open position and a closed position, said open position permitting flow from said first leg through said second leg, and said closed position preventing flow from said first leg through said second leg such that said flow from said first leg exits said conduit through said nozzle and said aperture.

2. The dredging apparatus of claim 1, wherein, when said flow valve is in its open position, said flow valve permits flow through said second leg toward said lower portion, to permit flow from both legs to said lower portion and out through said aperture.

3. The dredging apparatus of claim 2, wherein said lower portion has a substantially constant cross section.

4. The dredging apparatus of claim 1, further comprising a control valve operably connected to said first leg; said control valve having a fully open position to permit unrestricted flow from said first leg to said lower portion, and an intermediate position to provide restricted flow from said first leg to said lower portion and create suction downstream of the control valve.

5. The dredging apparatus of claim 4, wherein said control valve has a closed position which prevents flow from said first leg to said lower portion, to create suction in said lower portion when said control valve is in its closed position and said flow valve is in its open position.

6. The dredging apparatus of claim 5, wherein, when said flow valve is in its open position, said flow valve permits flow through said second leg toward said lower portion, to permit flow from both legs to said lower portion and out through said aperture.

7. The dredging apparatus of claim 4, wherein, when said flow valve is in its open position, said flow valve permits flow through said second leg toward said lower portion, to permit flow from both legs to said lower portion and out through said aperture.

8. The dredging apparatus of claim 7, wherein said lower portion has a substantially constant cross section.

9. The dredging apparatus of claim 4, wherein said lower portion has a substantially constant cross section.

10. The dredging apparatus of claim 1, further comprising a control valve operably connected to said first leg; said control valve having a closed position which prevents flow from said first leg to said lower portion, to create suction in said lower portion when said control valve is in its closed position and said flow valve is in its open position.

11. The dredging apparatus of claim 1, wherein said lower portion has a substantially constant cross section.

12. The dredging apparatus of claim 11, wherein said lower portion includes a plurality of intake apertures.

13. The dredging apparatus of claim 1, wherein said lower portion comprises a plurality of intake apertures.

14. The dredging apparatus of claim 1, wherein said nozzle extends from said first leg adjacent said lower portion.

15. The dredging apparatus of claim 1, wherein said nozzle comprises three jets extending from said first leg, said jets being spaced apart 120° around the circumference of said first leg.

16. The dredging apparatus of claim 1, wherein said lower portion is substantially U-shaped and includes a substantially horizontal bight portion, said intake aperture being on said bight portion.

17. The dredging apparatus of claim 16, wherein said lower portion has a substantially constant cross section.

18. The dredging apparatus of claim 17, wherein said bight portion includes a plurality of intake apertures.

19. Dredging apparatus for removing material from a bottom area of a body of water, comprising:

a flow conduit having a lower portion, a first leg, and a second leg; each said leg extending upwardly from the lower portion, said conduit being operable to communicate flow between the legs, and said lower portion having at least one intake aperture directed generally downwardly for receiving a water suspension of said material from said bottom area;

a first pump operably connected to the first leg, said first pump being operable to provide flow through said conduit;

a second pump operably connected to the second leg, said second pump being operable to provide flow through said conduit; and a fluidizing nozzle carried by said first leg and positioned to divert out of said conduit a portion of fluid flowing through said first leg toward said lower portion, said diverted fluid being directed against said bottom area for agitating and thereby generating said water suspension;

wherein said flow conduit has a substantially constant cross-sectional diameter substantially from said nozzle to said lower portion and past said intake aperture.

20. The dredging apparatus of claim 19, wherein said lower portion includes a plurality of intake apertures.

21. Dredging apparatus for removing material from a bottom area of a body of water, comprising:

a flow conduit including a substantially U-shaped lower portion, a first leg, and a second leg; each said leg extending substantially vertically from said lower portion; said conduit being operable to communicate flow between said legs; said lower portion having a substantially horizontal bight section; and said bight section having an intake aperture directed generally downwardly for receiving a water suspension of said material from said bottom area;

a first pump operably connected to the first leg, said first pump being operable to provide flow through said conduit;

a second pump operably connected to said second leg, said second pump being operable to provide flow through said conduit; and a fluidizing nozzle carried by said first leg and positioned to divert out of said conduit a portion of fluid flowing through said first leg toward said lower portion, said diverted fluid being directed against said bottom area for agitating and thereby generating said water suspension.

22. The dredging apparatus of claim 21, wherein said lower portion has a substantially constant cross section.

23. The dredging apparatus of claim 22, wherein said bight section includes a plurality of intake apertures.

24. A method for removing material from a bottom area of a body of water, said material being covered with overburden, comprising:

providing a dredge including a flow conduit having a lower portion and first and second upwardly extending legs that communicate with each other through said lower portion, a fluidizing nozzle carried by said first leg, and a downwardly directed intake aperture in said lower portion;

positioning said conduit in said water such that said intake aperture is directed towards the bottom area above said overburden;

pumping fluid through said first leg to said lower portion and out through said aperture, and moving said conduit downwardly, to clear said overburden away from said material;

then, pumping fluid through said conduit down said first leg, through said lower portion, and up said second leg; and simultaneously directing a portion of said fluid to exit said conduit through said nozzle, to stir up said material and thereby generate a water suspension of said material; and allowing said water suspension to enter said conduit through said aperture and to mix with said fluid, and continuing to pump said fluid to move said fluid and said water suspension up said second leg.

25. The method of claim 24, comprising pumping fluid down both of said legs and out through said aperture to clear said overburden away from said material.

26. The method of claim 24, in which the step of pumping fluid to clear said overburden comprises directing a portion of said fluid to exit said conduit through said nozzle.

27. The method of claim 24, in which the step of allowing said water suspension to enter said conduit comprises restricting flow through said first leg to said lower portion to create suction at said aperture.

28. The method of claim 27, comprising interrupting the step of pumping fluid through said conduit, then pumping fluid through said first leg to said lower portion and out through said aperture, and preventing flow from said lower portion through said second leg, to clear said aperture; and then resuming pumping fluid through said conduit.

29. The method of claim 28, comprising, while pumping fluid through said first leg to clear said aperture, also pumping fluid through said second leg to said lower portion and out through said aperture to help clear said aperture.

30. The method of claim 24, in which the steps of pumping fluid through said conduit and allowing said water suspension to enter said conduit comprise initially providing unrestricted flow through said first leg to said lower portion, and then restricting flow through said first leg to said lower portion to create suction at said aperture.

31. The method of claim 30, comprising, after providing unrestricted flow and before restricting flow, preventing flow through said first leg to said lower portion to increase suction at said aperture.

32. The method of claim 31, comprising interrupting the step of pumping fluid through said conduit; then pumping fluid through said first leg to said lower portion and out through said aperture, and preventing flow from said lower portion through said second leg, to clear said aperture; and then resuming pumping fluid through said conduit.

33. The method of claim 32, comprising, while pumping fluid through said first leg to clear said aperture, also pumping fluid through said second leg to said lower portion and out through said aperture to help clear said aperture.

34. The method of claim 30, comprising interrupting the step of pumping fluid through said conduit; then pumping fluid through said first leg to said lower portion and out through said aperture, and preventing flow from said lower portion through said second leg, to clear said aperture; and then resuming pumping fluid through said conduit.

35. The method of claim 34, comprising, while pumping fluid through said first leg to clear said aperture, also pumping fluid through said second leg to said lower portion and out through said aperture to help clear said aperture.

36. The method of claim 24, comprising interrupting the step of pumping fluid through said conduit; then pumping fluid through said first leg to said lower portion and out through said aperture, and preventing flow from said lower portion through said second leg, to clear said aperture; and then resuming pumping fluid through said conduit.

37. The method of claim 36, comprising, while pumping fluid through said first leg to clear said aperture, also pumping fluid through said second leg to said lower portion and out through said aperture to help clear said aperture.

* * * * *